United States Patent [19]

Okamoto

[11] 4,405,013

[45] Sep. 20, 1983

[54] ROTARY TYPE HEAT PIPE HEAT EXCHANGER

[75] Inventor: Eiji Okamoto, Kobe, Japan

[73] Assignee: Gadelius K.K., Tokyo, Japan

[21] Appl. No.: 209,102

[22] PCT Filed: Jan. 10, 1980

[86] PCT No.: PCT/JP80/00005

§ 371 Date: Sep. 10, 1980

§ 102(e) Date: Sep. 9, 1980

[87] PCT Pub. No.: WO80/01510

PCT Pub. Date: Jul. 24, 1980

[30] Foreign Application Priority Data

Jan. 10, 1979 [JP] Japan ..... 54-745

[51] Int. Cl.[3] ..... F28D 15/00

[52] U.S. Cl. ..... 165/86; 165/95; 165/104.14; 165/5; 165/DIG. 12

[58] Field of Search ..... 165/86, 92, 104.21, 165/104.26, 104.25, 95, 104.14, 5

[56] References Cited

U.S. PATENT DOCUMENTS 3,144,900 8/1964 Stockman ..... 165/5

FOREIGN PATENT DOCUMENTS 595956 5/1934 Fed. Rep. of Germany ..... 165/104.21

49-59338 6/1974 Japan .

49-128354 12/1974 Japan .

50-158962 12/1975 Japan .

50-158963 12/1975 Japan .

665299 1/1952 United Kingdom ..... 165/86

491016 11/1975 U.S.S.R. ..... 165/104.21

*Primary Examiner*—Albert W. Davis, Jr.

*Attorney, Agent, or Firm*—Shapiro and Shapiro

[57] ABSTRACT

A heat pipe heat exchanger for transferring heat from a high temperature fluid such as, for example, exhaust gas of a boiler, to a low temperature fluid comprises a first flow path (13,14,15,16,17) along which the high temperature fluid flows, a second flow path (18,19,20,21,22) along which the low temperature fluid flows, and a rotor (28) formed by a plurality of heat pipes (8) disposed across the two flow paths with such intervals that the high temperature fluid or the low temperature fluid can pass therebetween and transferring heat from the high temperature fluid to the low temperature fluid, and the rotor (28) has a separating member (9) fixed to the rotor and separating the first flow path (14,15,16) therein from the second flow path (19,20,21) and is rotatable. By this, corrosion, decreased wall thickness and clogging of the heat pipes is prevented from being localized in a particular portion thereof and the maintenance work of the heat exchanger can be facilitated.

4 Claims, 2 Drawing Figures

ROTARY TYPE HEAT PIPE HEAT EXCHANGER

TECHNICAL FIELD

This invention relates to a heat pipe heat exchanger, and particularly to a heat pipe heat exchanger which includes first flow path means along which a first fluid of relatively high temperature flows, second flow path means along which a second fluid of relatively low temperature flows, and a plurality of heat pipes disposed across and through the two flow paths so as to transfer heat from the first fluid to the second fluid, and which transfers heat from the first fluid to the second fluid.

BACKGROUND ART

Heretofore, as a typical heat exchanger of this type, there has been a fixed type heat pipe heat exchanger in which a plurality of heat pipes is arranged and fixed as a group and the central portion thereof is partitioned to form two flow paths on opposite sides so that a high temperature fluid flows along one of the flow paths and a low temperature fluid flows along the other flow path, so as to intersect the heat pipe group and by utilizing the characteristic of the heat pipes, the heat obtained from the high temperature fluid is transferred to the low temperature fluid through a fluid enveloped in the heat pipes. This fixed type heat exchanger is simple in construction and easy to manufacture, where as it suffers from a disadvantage that when it is used with a highly corrosive or highly clogging fluid, certain particular pipes, for example, the pipes at the low temperature portion, are corroded and clogged earlier than the pipes at the other region and the maintenance such as interchange or cleaning of such pipes is difficult.

It is an object of the present invention to eliminate such a disadvantage peculiar to the prior art and to provide a heat pipe heat exchanger in which corrosion or clogging of heat pipes is not localized at a particular region.

It is another object of the present invention to provide a heat pipe heat exchanger the maintenance of which is easy.

DISCLOSURE OF INVENTION

These objects are achieved by the heat pipe heat exchanger according to the present invention which will hereinafter be described. That is, this heat pipe heat exchanger includes a rotor formed by said plurality of heat pipes disposed with such intervals that a first or second fluid can pass therebetween, and this rotor includes separating means fixed to the rotor and separating a first flow path therein from a second flow path, and the rotor is rotatable.

According to an aspect of the present invention, the rotor may generally be of a cylindrical shape and a plurality of heat pipes may be disposed near the periphery thereof.

According to another aspect of the present invention, the heat pipe heat exchanger may include drive means for rotating said rotor.

According to still another aspect of the present invention, said rotor may include a plurality of deflecting means radially disposed relative to the axis of the cylindrical shape so as to introduce a first of second fluid into and out of the center of the rotor.

BRIEF DESCRIPTION OF DRAWINGS

These features and other objects of the present invention will become more fully apparent from the following detailed description taken in conjunction with the accompanying drawings, in which.

BEST MODE FOR CARRYING OUT THE INVENTION

Figure 1:
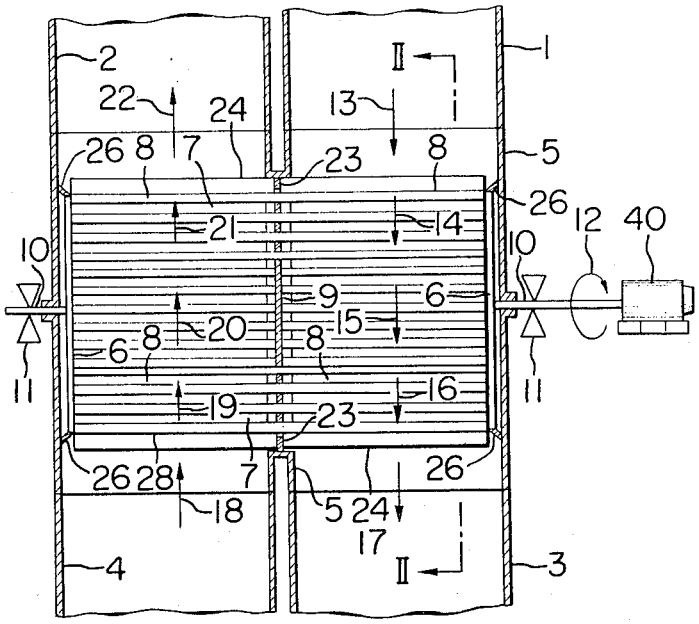
FIG. 1 is a schematic longitudinal cross-sectional view of the rotary type heat pipe heat exchanger according to the present invention.
Figure 2:
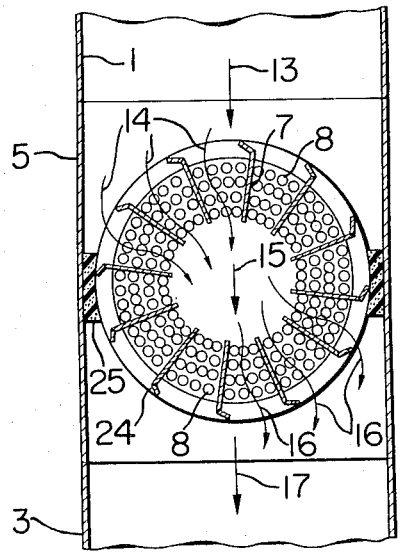
FIG. 2 is a vertical cross-sectional view of the FIG. 1 heat exchanger taken along line II—II of FIG. 1.

FIGS. 1 and 2 show an embodiment in which the rotary type heat pipe heat exchanger according to the present invention is applied to the gas to gas heat exchange, but it is apparent that the present invention is not limited to such gas heat exchange. In the Figures, a rotor 28 comprises two circular end plates 6, a suitable number of diaphragms 7 radially disposed with respect to a rotor shaft 10 and fixed to the two end plates 6, a suitable number of heat pipes 8 disposed in sector-shaped spaces formed between two adjacent diaphragms 7 and fixed to the two end plates 6, and a sealing wall 9 through which the heat pipes 8 extend and which is disposed so that high temperature gas and low temperature gas do not mix. The rotor 28 is rotatably supported relative to diagrammatically shown bearings 11 by the shaft 10 mounted centrally of the end plates 6. To improve the heat transfer efficiency, the heat pipes 8 may be provided with fins (not shown) and may have the heat transfer surfaces thereof enlarged. The rotor 28 is disposed in a casing 5 through which the shaft 10 extends. The casing 5 is connected to a high temperature gas inlet duct 1, a high temperature gas outlet duct 3, a low temperature gas inlet duct 4 and a low temperature gas outlet duct 2. To seal the gap between the rotor 28 and the casing 5, a central circumferential seal 23 is mounted on the outer peripheral portion of the sealing wall 9, an axial seal 24 is mounted axially of the outer peripheral portion of the diaphragms 7, an axial seal plate 25 as the partner surface of the axial seal is mounted on the side of the casing 5, and circumferential seals 26 are mounted on the outer peripheral portions of the end plates 6.

High temperature gas introduced from the high temperature gas inlet duct 1 flows into the casing 5 as indicated by arrow 13 and passes between the heat pipes 8 as indicated by arrow 14, thereby giving heat to the heat pipes 8. This gas further flows into the central portion of the rotor 28 and flows as indicated by arrow 15, and again flows between the heat pipes 8 as indicated by arrow 16, thereby further giving heat to the heat pipes 8 and being cooled, and flows out toward the high temperature gas outlet duct 3 as indicated by arrow 17. On the other hand, low temperature gas flows from the low temperature gas inlet duct 4 into the casing 5 as indicated by arrow 18 and passes between the heat pipes 8 as indicated by arrows 19, 20 and 21, thereby absorbing heat from the heat pipes 8, namely, being heated, and flows out toward the low temperature gas outlet duct 2 as indicated by arrow 22.

The half cylindrical portion of the rotor 28 in which the high temperature gas flows into the central portion of the rotor 28 from the outer peripheral portion thereof or the low temperature gas flows out toward the outer peripheral portion of the rotor 28 from the central portion thereof is referred to as the high temperature side, and the half cylindrical portion on the opposite side is referred to as the low temperature side. Usually, the high temperature gas is the exhaust gas from a boiler or the like, and the heat transfer surfaces chiefly on the low temperature side may often be corroded by hydrogen sulfate and dust contained in the exhaust gas to cause decreased wall thickness or clogging.

According to the present invention, the shaft 10 is driven as indicated by arrow 12 by a driving device 40 such as a motor or the like to rotate the rotor 28, thereby moving the portion of the heat pipe group 8 located at the low temperature side toward the high temperature side and moving the high temperature side toward the low temperature side. By so rotating the rotor 28 temporally or continuously, the corrosion or decreased wall thickness of the heat transfer surfaces of the heat pipes 8 may be uniformized and accordingly, the life of the heat transfer surfaces may be substantially uniformized.

There is also an advantage that the work of interchanging the heat pipes can be accomplished in place as by the operator manually rotating the rotor 28 temporally. A soot blowing device is used for the purpose of preventing the clogging of the heat transfer surfaces, and according to the present invention, a soot blowing nozzle may be disposed in place so that a soot blowing medium can be injected from the outer peripheral portion of the rotor to the central portion thereof and by rotating the rotor 28, it is possible to effect the soot blowing on the circumference of the rotor at that position and, if a suitable number of nozzles are disposed axially, the soot blowing on the entire outer peripheral portion will be possible. Also, if the rotor 28 is rotated while the nozzles are moved axially of the rotor 28, the soot blowing on the entire outer peripheral portion will be possible by minimum one nozzle on each of the high temperature side and the low temperature side. Where the soot blowing from the outer peripheral portion is insufficient, if the rotor shaft 10 is made hollow and a suitable seal device is provided, it will be possible to dispose a nozzle at the central portion of the rotor 28 and effect the soot blowing from the central portion to the outer peripheral portion of the rotor 28. Also, if both the soot blowing from the outer peripheral portion and the soot blowing from the central portion are used, the soot blowing of almost all the heat transfer surfaces will be possible.

The accumulated materials which adhere to the low temperature side and clog the heat transfer surfaces often present wet condition and can hardly be removed even by the soot blowing, but if the rotor 28 is rotated to move the heat transfer surfaces on the low temperature side to the high temperature side, there will also be an advantage that the accumulated materials become dry and peel off the heat transfer surfaces, so that they can be readily removed by the soot blowing.

The embodiment of FIGS. 1 and 2 shows a case where the axial direction of the rotor 28 is horizontal, but needless to say, the rotor 28 may be designed into a suitable construction such that the axial direction of the rotor 28 is inclined at a certain angle or vertical.

I claim:

1. A heat pipe heat exchanger including first flow path means along which a first fluid of relatively high temperature flows, second flow path means along which a second fluid of relatively low temperature flows, and a plurality of heat pipes disposed across and through said two flow paths so that heat is transferred from said first fluid to said second fluid, characterized in that said heat exchanger includes a rotor formed by said plurality of heat pipes disposed with such intervals that said first and second fluids can pass therebetween, said rotor includes separating means fixed to said rotor and separating said first flow path means from said second flow path means, and said rotor has means for rotating said rotor so that said heat pipes are rotated temporally by 180° from a low temperature region to a high temperature region for drying materials accumulated on the rotor in order that the dried materials may then, successively be blown off of said rotor by blowing means.

2. A heat pipe heat exchanger in accordance with claim 1, including means for directing said blowing radially of said rotor.

3. A heat pipe heat exchanger in accordance with claim 1, wherein said rotor has radial vanes thereon for directing fluid over said heat pipes radially of said rotor.

4. A heat pipe heat exchanger in accordance with claim 3, wherein the outer tips of said vanes comprise sealing means which cooperate with fixed sealing means to separate said high temperature and low temperature regions.

* * * * *